US006285130B1

(12) United States Patent
Nakagawa et al.

(10) Patent No.: US 6,285,130 B1
(45) **Date of Patent: *Sep. 4, 2001**

(54) METAL HALIDE LAMP

(75) Inventors: Atsuji Nakagawa; Toshitaka Fujii; Tetsuya Shirai; Tatsuo Yamamoto; Tomihiko Ikeda, all of Himeji (JP)

(73) Assignee: Phoenix Electric Co., Ltd., Himeji (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/133,957

(22) Filed: Aug. 14, 1998

(30) Foreign Application Priority Data

Sep. 1, 1997 (JP) ..... 9-252754

(51) Int. Cl.[7] ..... H01J 61/18; H01J 61/06
(52) U.S. Cl. ..... 313/620; 313/639; 445/26
(58) Field of Search ..... 313/571, 641, 313/640, 639, 620, 638; 445/26

(56) References Cited

U.S. PATENT DOCUMENTS

| | | | | |
|---|---|---|---|---|
| 4,020,377 | * | 4/1977 | Popp et al. | 313/571 |
| 4,686,419 | * | 8/1987 | Block et al. | 313/641 |
| 5,451,838 | * | 9/1995 | Kawai | 313/641 |
| 5,691,601 | * | 11/1997 | Frey et al. | 313/571 |
| 5,831,388 | * | 11/1998 | Genz et al. | 313/571 |

FOREIGN PATENT DOCUMENTS 7-32004 4/1995 (JP) .

* cited by examiner

*Primary Examiner*—Michael H. Day
(74) *Attorney, Agent, or Firm*—Oblon, Spivak, McClelland, Maier & Neustadt, P.C.

(57) ABSTRACT

A metal halide lamp includes a pair of electrodes with a spacing of 0.5 to 1.5 mm therebetween, an envelope enclosing the pair of electrodes, and at least one metal halide, other than a mercury halide, that is encapsulated in the envelope in an amount of from 0.04 to 0.3 mg/cc, wherein the metal halide lamp operates in a power range from 75 to 270 watts per millimeter across the spacing between the pair of electrodes.

4 Claims, 4 Drawing Sheets

METAL HALIDE LAMP

BACKGROUND OF THE INVENTION

1. Field of the Invention

The present invention relates to improvements in metal halide lamps and, more particularly, to improvements in metal halide lamps for use in optical instruments.

2. Description of the Prior Art

Metal halide lamps are used in optical instruments such as liquid crystal projectors and OHPs as incorporated in their reflectors. In recent years, to increase the screen brightness, metal halide lamps of the type having a pair of electrodes with a reduced spacing therebetween have been developed and widely used so that light from the lamp can be effectively utilized by a reflector. However, such a metal halide lamp causes an undesirable decrease in its own emission efficiency (lm/W) due to the reduced spacing between the electrodes. ("lm" means lumen.)

Attempts have been made to increase the emission efficiency of such metal halide lamp by encapsulating an excessive amount of a metal halide in the lamp. However, although the metal halide excessively encapsulated in the lamp enhances the emission efficiency of the lamp as intended, the screen brightness tends to decrease contrary to the expectation.

One conceivable reason for this problems is that the excessive metal halide encapsulated in the lamp does not sufficiently vaporize during the operation of the lamp and adheres to an inner wall surface of the lamp. This causes shadow and hence a decrease in the screen brightness.

Further, the metal halide excessively encapsulated in the lamp causes devitrification of the light-emitting tube formed of quartz glass and corrosion of the electrodes, which leads to the lamp with a shorter life time. Furthermore, convection occurring within the tube during the operation of the lamp is disturbed due to the excessive encapsulation of the metal halide, resulting in flicker.

It is, therefore, an object of the present invention to provide a metal halide lamp which is capable of increasing a screen brightness with less flicker and enjoys a longer life time by restricting the amount of a metal halide to be encapsulated in the lamp to a specific range.

SUMMARY OF THE INVENTION

In accordance with a first aspect of the present invention, there is provided a metal halide lamp for use with a reflector, comprising a pair of electrodes with a spacing therebetween, an envelop enclosing the pair of electrodes, and at least one metal halide other than a mercury halide which is encapsulated in the envelop in an amount of from 0.04 to 0.3 mg/cc.

In accordance with a second aspect of the present invention, there is provided a metal halide lamp for use with a reflector, comprising a pair of electrodes with a spacing therebetween, an envelop enclosing the pair of electrodes, a mercury halide encapsulated in the envelop, and at least one metal halide other than the mercury halide which is encapsulated in the envelop in an amount of from 0.04 to 0.3 mg/cc, the molar ratio of the mercury halide to the at least one metal halide other than the mercury halide being in the range of from 1.3 to 4.4.

In these constructions, the amount of the metal halide other than a mercury halide, or the molar ratio of the mercury halide to the at least one metal halide other than the mercury halide is restricted to a limited range. When such lamp is used in the reflector of an optical instrument as a light source, extra light emission which does not contribute to an improvement in the screen brightness is decreased, while on the other hand light emission which leads to an increase in the screen brightness is increased. Further, the lamp enjoys a longer life time with less flicker.

The foregoing and other objects, features and attendant advantages will become readily apparent from the reading of the following detailed description of the invention in conjunction with the attached drawings.

BRIEF DESCRIPTION OF THE DRAWINGS

FIG. 3(*b*) is a graph showing a luminance distribution of the lamp shown in FIG. 3(*a*);

FIG. 4(*b*) is a graph showing a luminance distribution of the conventional lamp shown in FIG. 4(*a*).

DETAILED DESCRIPTION OF THE PREFERRED EMBODIMENTS

The present invention will now be described in detail with reference to the accompanying drawings.

Figure 1:
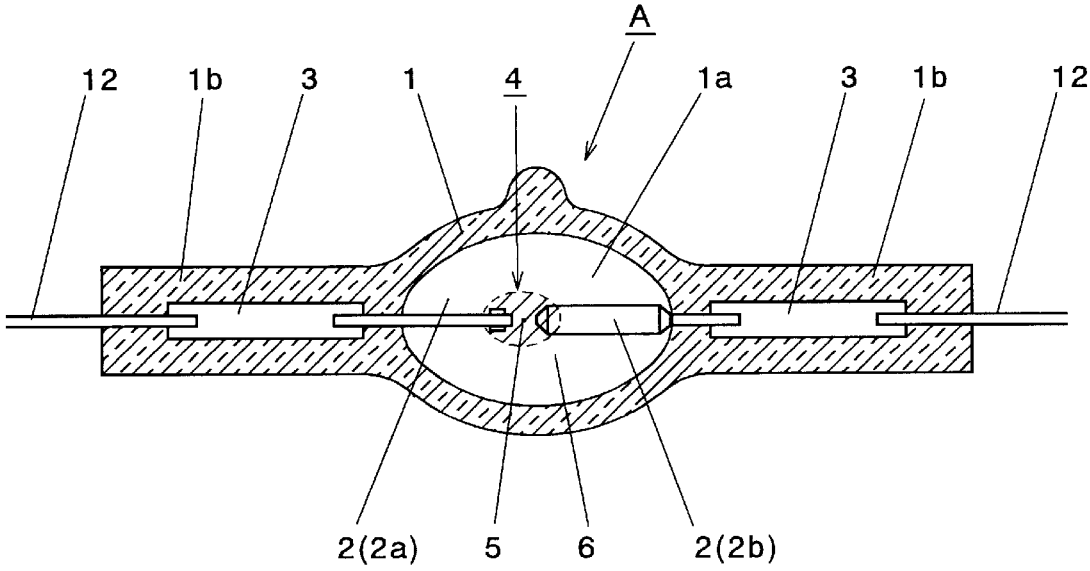
FIG. 1 is a sectional view illustrating a metal halide lamp according to the present invention.
Figure 3:
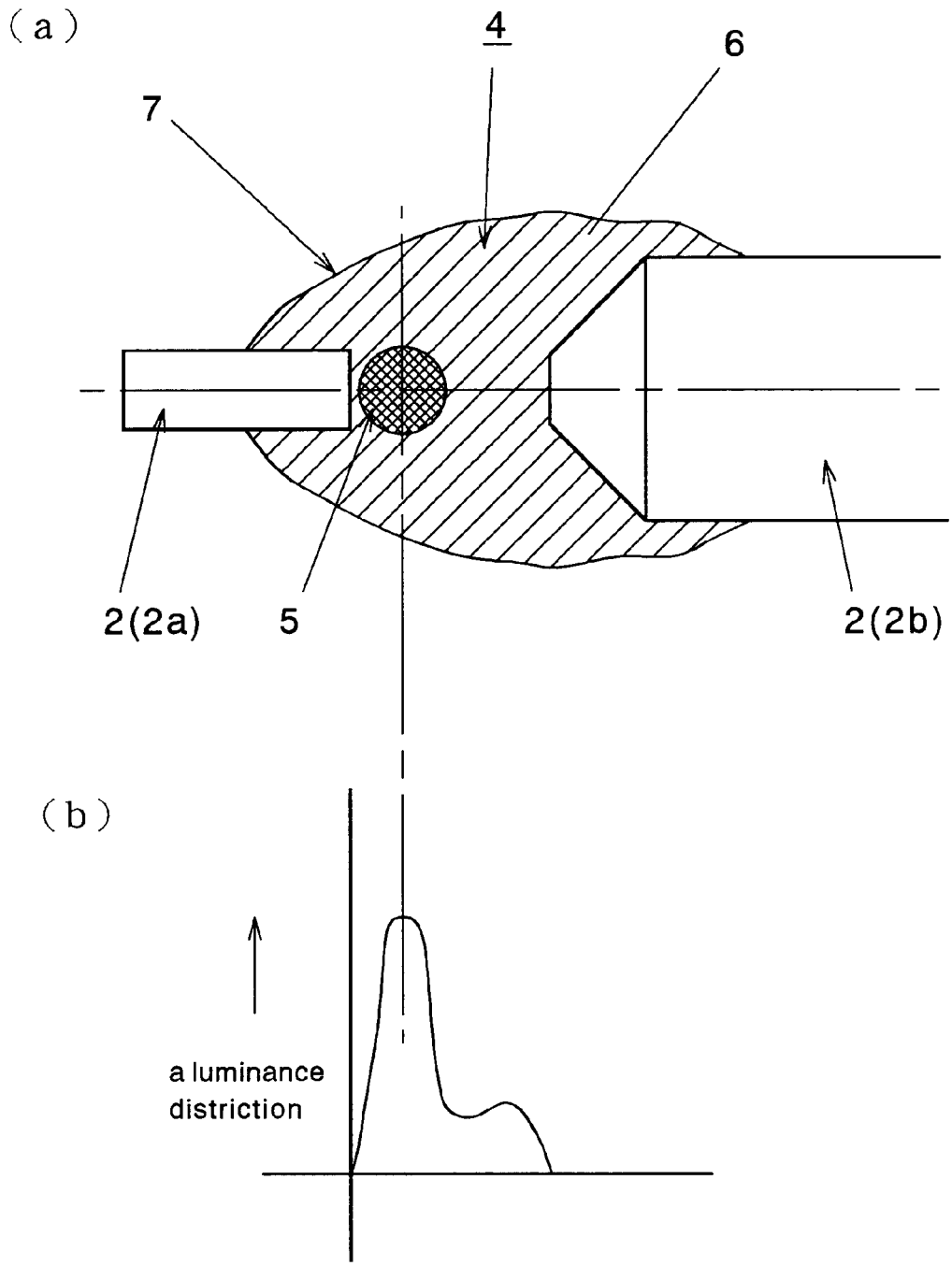
FIG. 3(*a*) is an enlarged sectional view illustrating a portion of a metal halide lamp in which arc is produced according to the present invention.

When metal halide lamp (A) shown in FIG. 1 is turned on, arc is produced between the pair of electrodes (2) as shown in FIG. 3. At that time, a luminescent spot (5) having an intensified luminance within a very narrow region (of about 0.5 mm in diameter) appears and a luminous peripheral region (6) surrounding the luminescent spot (5) is formed. Where the lamp is operated from a DC power supply, the luminescent spot (5) is formed at only one location adjacent the cathode. On the other hand, where the lamp is operated from an AC power supply, the luminescent spot (5) is formed at two locations adjacent respective electrodes. Although the DC-operated case will be exemplarily explained throughout the specification, the present invention is not limited thereto, and an AC power supply can also be employed.

The lamp (A) according to the present invention comprises a pair of electrodes with a spacing therebetween, an envelop enclosing the pair of electrodes, and at least one metal halide other than a mercury halide which is encapsulated in the envelop in an amount of from 0.04 to 0.3 mg/cc, or a pair of electrodes with a spacing therebetween, an envelop enclosing the pair of electrodes, a mercury halide encapsulated in the envelop, and at least one metal halide other than the mercury halide which is encapsulated in the envelop in an amount of from 0.04 to 0.3 mg/cc, the molar ratio of the mercury halide to the at least one metal halide other than the mercury halide being in the range of from 1.3 to 4.4.

With such construction, the luminescent spot (5) of the metal halide lamp (A) exhibits a luminance much higher than that of a conventional lamp under the same condition.

When the metal halide lamp (A) is used in a reflector, it is disposed so that the luminescent spot (5) generally coincides with the focus of the reflector.

By the use of the metal halide lamp (A) in a reflector (refer to FIG. 2) as the light source of an optical instrument, the screen brightness is enhanced in the manner described below.

A certain optical instrument includes an LCD panel (9) through which light passes, and an image on the LCD panel (9) is reflected on a screen (10). Accordingly, of the light emitted from the light source, only a portion directed to the LCD panel (9) can be utilized effectively. The rest which is not directed to the panel (9) does not reach the screen and, therefore, is useless.

In this respect, the light source of an optical instrument produces necessary light (5*a*) which passes through an LCD panel and contributes to the screen brightness, and excessive or unnecessary light (6*a*) which does not contribute to the screen brightness.

In the optical instrument, the light source is positioned in the reflector (8) so that the luminescent spot (5) coincides with the focus of the reflector. Accordingly, light of the luminescent spot (5) and light from a region in close proximity with the luminescent spot (5) form the necessary light (5*a*) which passes through the LCD panel (9).

However, most of light emitted from the peripheral region (6) surrounding the luminescent spot (5) does not pass through the LCD panel (9) and, hence, does not contribute to the screen brightness. Accordingly, this portion of light is unnecessary. Thus, no matter how bright the peripheral region (6) is, the screen brightness can not be improved. To enhance the screen brightness, it is most important to enhance the luminance of the luminescent spot (5).

The metal halide lamp (A) of the present invention provides a luminescent spot (5) having a higher luminance and hence is capable of improving the screen brightness.

According to the present invention, flicker is eliminated or lessened in the following manner. Since the amount of the metal halide or metal halides to be encapsulated is restricted within a specific range according to the present invention, a greater amount of necessary light is emitted while unnecessary light is decreased when a voltage is applied across the pair of electrodes to produce arc.

Figure 4:
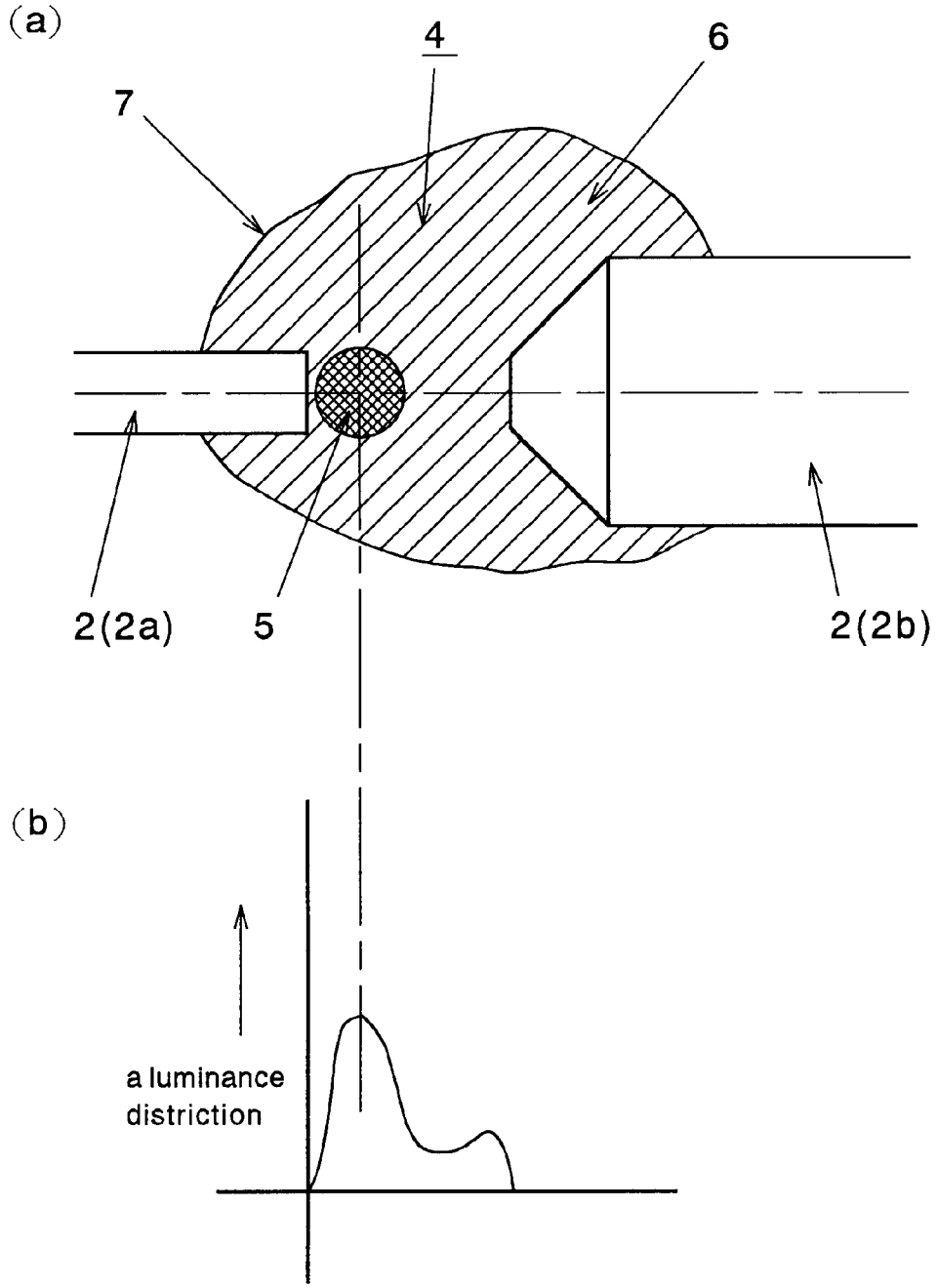
FIG. 4(*a*) is an enlarged sectional view illustrating a portion of a conventional metal halide lamp in which arc is produced.

Referring to FIGS. 3 and 4, the peripheral region (6) surrounding the luminescent spot (5) is very unstable in temperature distribution. Due to the convection of the filling gas in the light-emitting tube portion of the metal halide lamp, fluctuation occurs at the boundary (7) between the luminous peripheral region (6) and the outside region which does not emit light. Such fluctuation causes flicker to occur on the screen. Since the luminous peripheral region (6) of the lamp according to the present invention is smaller than that of a conventional one, the unstable region is reduced and, hence, flicker is lessened.

It should be noted that due to smaller amounts of the metal halide and/or the mercury halide, the metal halide lamp according to the present invention offers a lower emission efficiency of the lamp itself than a conventional one which is aimed at a higher emission efficiency.

Figure 2:
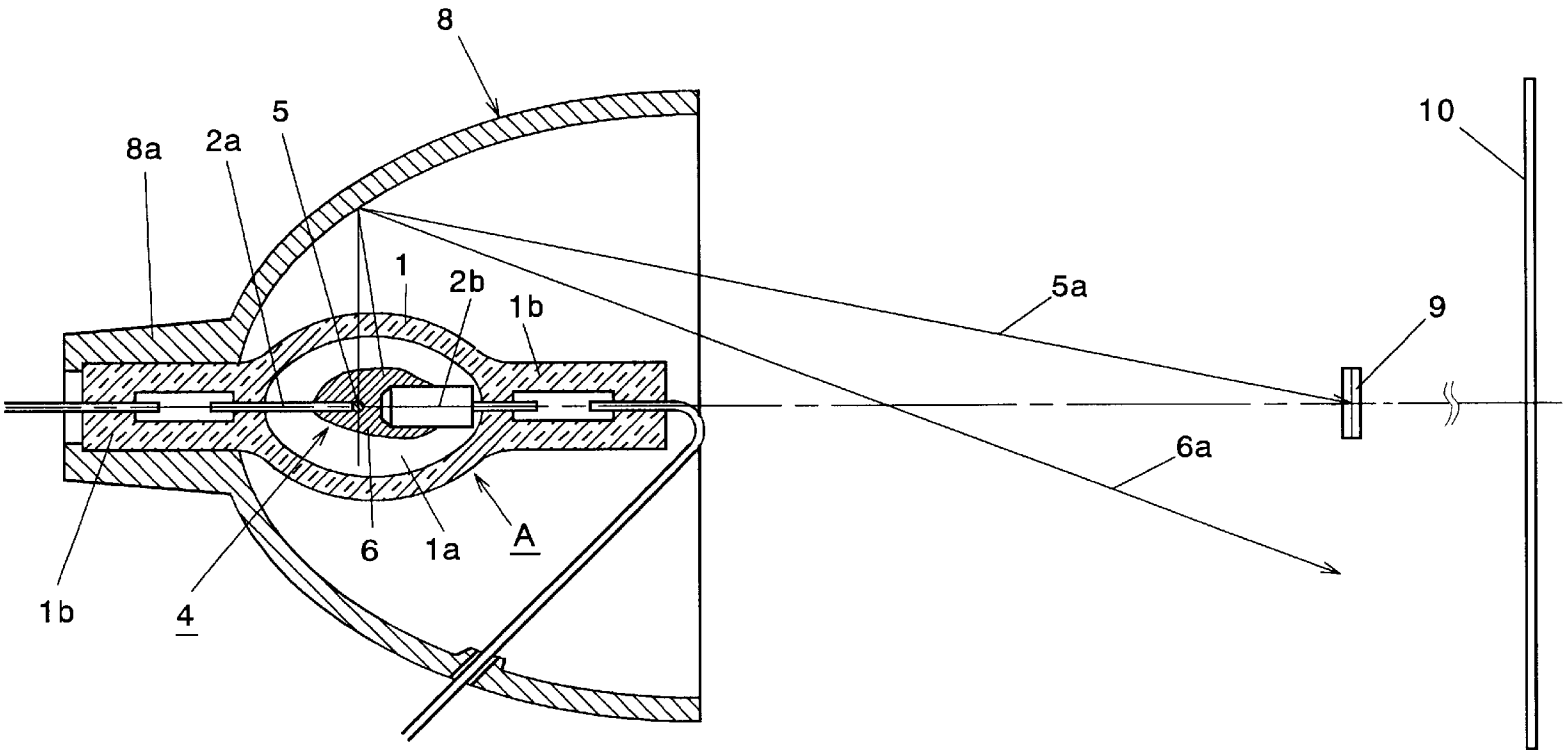
FIG. 2 is a sectional view illustrating a metal halide lamp as attached to a reflector and turned on according to the present invention.

However, the present invention is not aimed at an improvement in the emission efficiency of the lamp itself but pursues a great contribution to an improved screen brightness when the lamp is used with a reflector. Specifically, when the metal halide lamp (A) of the present invention is used as attached to a cylindrical portion of reflector (8) as shown in FIG. 2, light (5*a*) from the luminescent spot (5) substantially coinciding with the focus of the reflector and from a region in close proximity to the luminescent spot (5) passes through an effective use area (9) and reaches the screen. Thus, this portion of light is necessary light (5*a*) which contributes to an improvement in the screen brightness.

On the other hand, light from the luminous peripheral region (6) surrounding the luminescent spot (5) does not pass through the effective use area (9) or the LCD panel as described above and, hence, does not contribute to the screen brightness. Therefore, although the metal halide lamp (A) according to the present invention has a decreased emission efficiency in terms of the lamp itself, the luminance of the luminescent spot (5) is enhanced, resulting in a great contribution to an improvement in the screen brightness.

Further, since the amount of the metal halide and/or the mercury halide encapsulated in the lamp is restricted to a smaller amount in the specified range according to the present invention, the reaction of quartz glass and the metal halides is decreased. Accordingly, devitrification or blackening of the lamp can be avoided, which leads to the metal halide lamp offering a longer life time.

Representative examples of the present invention will be described more specifically.

FIG. 1 is a sectional view of one representative example of DC-operated metal halide lamp (A) in accordance with the present invention. It is to be noted that the present invention is applicable to AC-operated metal halide lamps of the double-end type or DC-and-AC-operated metal halide lamps of the single-end type, though these types of lamps are not shown. In an AC-operated lamp, a pair of electrodes (2) having the same shape are used, while in a DC-operated lamp, anode (2*b*) formed of tungsten is larger in diameter than cathode (2*a*).

The metal halide lamp (A) shown includes a lamp envelop (1) formed of quartz glass and having a light-emitting tube portion (la) of a substantially spherical shape with rectangular seal portions (1*b*) formed at opposite ends thereof. A pair of electrodes (2) each welded to the inner end of a sealing foil (3) formed of molybdenum and embedded in each seal portion (1*b*) project into the light-emitting tube portion (1*a*) so as to be opposed to each other with a certain spacing therebetween. The spacing between the electrodes is not limited, but in the range of from 1.5 to 2 mm in this example. Such spacing is typically in the range of from 0.5 to 3 mm.

Predetermined amounts of mercury and argon gas are contained in the light-emitting tube portion (1*a*). Additionally, at least one metal halide other than a mercury halide may be encapsulated in an amount of 0.04 to 0.3 mg/cc. Alternatively, a combination of at least one metal halide other than a mercury halide in an amount of 0.04 to 0.3 mg/cc and the mercury halide may be encapsulated so that the molar ratio of the mercury halide to the at least one metal halide is in the range of 1.3–4.4.

An outer lead pin (12) is attached to the outer end of the sealing foil (3) in each seal portion (1*b*) so as to project outwardly from the corresponding seal portion (1*b*).

The metal halide lamp (A) thus formed is inserted at one end thereof into a cylindrical portion (8*a*) of reflector (8) so that the arc producing point between the electrodes (2) coincides with the focus of the reflector (8), and is secured thereto by the use of an adhesive or is mechanically fixed thereto by a metal member.

When power is applied to the electrodes (2), arc (4) is produced between the electrodes (2). Arc (4) forms a luminescent spot (5) and a luminous peripheral region (6) surrounding the luminescent spot (5). Light from the luminescent spot (5) and from a region in close proximity thereto passes through LCD panel (9) to form images on screen (10).

EXAMPLE 1

A first example of metal halide lamp (A) in accordance with the present invention included a generally spherical light-emitting tube portion (1*a*) having an outer diameter of 15 mm and an internal volume of 1 cc.

Predetermined amounts of dysprosium bromide as a light emitting metal, mercury and argon gas were encapsulated in the metal halide lamp (A). The spacing between a pair of electrodes was 2 mm.

This metal halide lamp (a) was turned on through an electronic ballast at a lamp power of 350 watts from a DC power supply.

Metal halide maps (1)–(6) of such construction were fabricated as containing a varying amount of dysprosium bromide to examine the characteristics of the lamps including emission efficiency (lm/W), fluctuation In the luminous peripheral region (S) and screen brightness (1×). Lamps (1)–(6) were fabricated under the same condition except that the amount of dysprosium bromide was varied. The results are shown in Table 1. In this and the subsequent Tables, lamps (2) to (5) were within the scope or the present invention,

TABLE 1

| | (1) | (2) | (3) | (4) | (5) | (6) |
|---|---|---|---|---|---|---|
| Amount of dysprosium bromide (mg/cc) | 0.03 | 0.05 | 0.1 | 0.2 | 0.3 | 0.4 |
| Emission efficiency (1 m/W) | 45 | 47 | 50 | 51 | 54 | 58 |
| Fluctuation in the luminous peripheral region | ○ | ○ | ○ | ○ | Δ | × |
| Screen brightness (1 x) | 520 | 620 | 630 | 600 | 580 | 490 |

Note that the presence of absence of fluctuation in the luminous peripheral region (6) was visually checked by projecting each lamp upon a screen by the use of a lens. The mark ○ indicates that fluctuation was not recognized while the mark X indicates that fluctuation was recognized. The mark Δ Indicates that slight fluctuation which was judged to be negligible in use was recognized. The meanings of these marks are the Same in the subsequent Tables.

As can be seen from Table 1, as the amount of the metal halide (dysprosium bromide) increased, the screen brightness was degraded although the emission efficiency of the lamp itself is enhanced. With the lamp (6) containing a conventional amount of the metal halide, the screen brightness was lower than the lamps (2) to (5), and further, fluctuation was caused.

Where the amount of dysprosium bromide was 0.03 mg, the screen brightness was lower than intended because the absolute amount of the light emitting metal was insufficient.

EXAMPLE 2

A second example of metal halide lamp (A) in accordance with the present invention included a generally spherical light-emitting tube portion (1*a*) having an outer diameter of 14 mm and an internal volume of 0.8 cc.

Predetermined amounts of indium iodide and dysprosium iodide as light emitting metals, mercury and argon gas were encapsulated in the metal halide lamp (A). The spacing between a pair of electrodes was 1.5 mm.

This metal halide lamp (a) was turned on through an electronic ballast at a lamp power of 250 watts from a DC power supply.

Metal halide lamps (1)–(6) of such construction were fabricated as containing a varying combined amount of indium iodide and dysprosium iodide to examine the characteristics of the lamps including emission efficiency (lm/W), fluctuation in the luminous peripheral region (6) and screen brightness (1×). Lamps (1)–(6) were fabricated under the same condition except that the combined amount of indium iodide and dysprosium iodide was varied. The results are shown in Table 2.

TABLE 2

| | (1) | (2) | (3) | (4) | (5) | (6) |
|---|---|---|---|---|---|---|
| Combined amount of indium iodide and dysprosium iodide (mg/cc) | 0.03 | 0.05 | 0.1 | 0.2 | 0.3 | 0.4 |
| Emission efficiency (1 m/W) | 38 | 40 | 41 | 44 | 45 | 50 |
| Fluctuation in the luminous peripheral region | ○ | ○ | ○ | ○ | Δ | × |
| Screen brightness (1 x) | 350 | 400 | 414 | 375 | 360 | 340 |

As seen from Table 2, lamps (2)–(5) each offered an enhanced screen brightness as In Example 1.

EXAMPLE 3

A third example of metal halide lamp (A) in accordance with the present invention included a generally spherical light-emitting tube portion (1*a*) having an outer diameter of 15 mm and an internal volume of 1.0 cc.

Predetermined amounts of dysprosium bromide and mercury iodide an light emitting metals, mercury and argon gas were encapsulated in the metal halide lamp (A). The spacing between a pair of electrodes was 2.0 mm.

This metal halide lamp (a) was turned on through an electronic ballast at a lamp power of 350 watts from a DC power supply.

Metal halide lamps (1)–(6) of such construction were fabricated as containing a varying amount of mercury iodide and 0.1 mg of dysprosium bromide to examine the characteristics of the lamps including emission efficiency (lm/w), fluctuation In the luminous peripheral region (6) and screen brightness (1×). Lamps (1)–(6) were fabricated under the same condition except that the amount of mercury iodide was varied. The results are shown in Table 3.

TABLE 3

| | (1) | (2) | (3) | (4) | (5) | (6) |
|---|---|---|---|---|---|---|
| Molar ratio of mercury iodide to other metal halide (mg X/MH) | 0 | 1.3 | 1.8 | 2.7 | 4.4 | 4.8 |
| Amount of dysprosium bromide (mg/cc) | 0.1 | 0.1 | 0.1 | 0.1 | 0.1 | 0.1 |
| Emission efficiency (1 m/W) | 50 | 54 | 55 | 54 | 56 | 56 |
| Fluctuation in the luminous peripheral region | ○ | ○ | ○ | ○ | Δ | × |
| Screen brightness (1 x) | 630 | 660 | 670 | 690 | 730 | 690 |

As can be seen from Table 3, the screen brightness was enhanced as the amount of mercury Iodide increased, but excessive amount of mercury iodide caused fluctuation in the luminous peripheral region. Thus, the range of molar ratio of mercury iodide to other metal halide in accordance with the present invention is judged to be optimum.

Although dysprosium bromide, indium iodide, dysprosium iodide and mercury iodide were used either individually or in combination as light emitting metals in Examples 1 to 3, any other kinds of metal halides may be used in the present invention. Further, the emission efficiency of the lamp itself is not limitative of the present invention.

As described above, the present invention provides a metal halide lamp which ensures a higher screen brightness with less fluctuation. Further, since the amount of the metal halide(s) contained in the lamp is small, the reaction between quartz glass and the metal halide(s) is decreased, which leads to the lamp offering a longer life time.

While only certain presently preferred embodiments of the invention have been described herein in detail, as will be apparent with those familiar with the art, certain changes and modifications can be made in embodiments without departing from the spirit and scope of the invention as defined by the following claims.

What is claimed is:

1. A metal halide lamp comprising:

a pair of electrodes with a spacing of from 0.5 to 1.5 mm therebetween, an envelope enclosing the pair of electrodes, and at least one metal halide, other than a mercury halide, that is encapsulated in the envelope in an amount of from 0.04 to 0.3 mg/cc, wherein the metal halide lamp operates in a power range of from 75 to 270 watts per millimeter across the spacing between the pair of electrodes.

2. A method of forming a metal halide lamp, the method comprising encapsulating at least one metal halide, other than a mercury halide, in an envelope, and forming the metal halide lamp of claim 1.

3. A metal halide lamp comprising:

a pair of electrodes with a spacing of from 0.5 to 1.5 mm therebetween, an envelope enclosing the pair of electrodes, a mercury halide encapsulated in the envelope, and at least one metal halide, other than the mercury halide, that is encapsulated in the envelope in an amount of from 0.04 to 0.3 mg/cc, wherein a molar ratio of the mercury halide to the at least one metal halide other than the mercury halide is in a range of from 1.3 to 4.4, and the metal halide lamp operates in a power range of from 75 to 270 watts per millimeter across the spacing between the pair of electrodes.

4. A method of forming a metal halide lamp, the method comprising encapsulating a mercury halide and at least one metal halide, other than the mercury halide, in an envelope, and forming the metal halide lamp of claim 3.

* * * * *